US007559739B2

(12) United States Patent
Colonna et al.

(10) Patent No.: US 7,559,739 B2
(45) Date of Patent: Jul. 14, 2009

(54) MOVEMENT SYSTEM FOR THE INSPECTION OF A TURBINE

(75) Inventors: Francesco Colonna, Prato (IT); Lorenza Sassolini, Perugia (IT); Luca Poli, Pisa (IT)

(73) Assignee: Nuovo Pignone S.p.A., Florence (IT)

( * ) Notice: Subject to any disclaimer, the term of this patent is extended or adjusted under 35 U.S.C. 154(b) by 404 days.

(21) Appl. No.: 11/461,066

(22) Filed: Jul. 31, 2006

(65) Prior Publication Data

US 2007/0031242 A1 Feb. 8, 2007

(30) Foreign Application Priority Data

Aug. 2, 2005 (IT) ..... MI2005A1519

(51) Int. Cl.
*F01D 25/34* (2006.01)

(52) U.S. Cl. ..... 415/118; 415/122.1; 416/170 R

(58) Field of Classification Search ..... 415/118, 415/122.1, 123, 124.1; 416/170 R
See application file for complete search history.

(56) References Cited

U.S. PATENT DOCUMENTS

| | | | | | |
|---|---|---|---|---|---|
| 3,201,941 | A | * | 8/1965 | La Fleur | 60/682 |
| 3,404,579 | A | * | 10/1968 | Feller | 74/354 |
| 3,485,041 | A | * | 12/1969 | Evans | 60/788 |
| 3,919,894 | A | * | 11/1975 | Keeter et al. | 74/384 |
| 5,670,879 | A | | 9/1997 | Zombo et al. | |
| 6,804,622 | B2 | | 10/2004 | Bunker et al. | |
| 6,886,407 | B1 | | 5/2005 | Fredenberg | |

* cited by examiner

*Primary Examiner*—Ninh H Nguyen
(74) *Attorney, Agent, or Firm*—Global Patent Operation

(57) ABSTRACT

Movement system (10) for the inspection of a turbine (40) of the type equipped with a shaft (42) having a series of blades, which is coupled with a shaft (72) of a compressor (70) by means of a loading joint (80), the system (10) comprises a crank rotation mechanism (20) in turn comprising a reducer group (24) for rotating the shaft (42) of the turbine (40) to allow the inspection of the series of blades by means of a boroscope, avoiding the necessity of decoupling the turbine (40) from the compressor (70).

9 Claims, 2 Drawing Sheets

MOVEMENT SYSTEM FOR THE INSPECTION OF A TURBINE

BACKGROUND OF THE INVENTION

The present invention relates to a movement system for the inspection of a turbine, in particular for a turbine connected to a centrifugal compressor.

During the useful life of a turbine, maintenance operations are envisaged which are necessary for guaranteeing the correct functioning of the turbine.

During these periodical operations, controls and inspections are effected and damaged or worn parts or components are possibly substituted.

The parts of a turbine which are most subject to wear are the turbine blades as they undergo mechanical stress at a high temperature and are also subject to hot corrosion due to the hot gases with which the turbine operates.

This consequently creates the necessity of periodical inspections of the turbine blades to control their integrity and functionality.

During programmed maintenance operations, in order to be able to inspect the blades of the turbine, it is therefore normally necessary to rotate the blades of the turbine itself in particular by rotating the whole turbine rotor.

This is applied especially in the case of a boroscopic inspection.

In order to effect this type of inspection, the turbine must first be decoupled from a centrifugal compressor connected thereto.

More specifically, in order to decouple the turbine and compressor, a loading joint is disassembled. The loading joint connects the shaft of the turbine to the shaft of the centrifugal compressor.

This operation is extremely difficult and also requires specialized labor to avoid damaging a conical coupling situated in particular on the shaft of the centrifugal compressor.

The turbine is then opened and the blades are inspected by means of a boroscope.

As a result of the reduced visibility, it is also necessary to rotate the shaft of the turbine to be able to inspect all of its blades.

The shaft of the low-pressure turbine is then rotated manually by acting on the portion of the turbine shaft, which has been decoupled at the loading joint.

The reason for this is that the shaft of the turbine is not normally very accessible.

Another disadvantage is that a total of two or three days are necessary for dismantling the turbine, inspecting the blades of the turbine and assembling and reactivating it again.

It is consequently evident that the stoppage time of the turbine represents a considerable cost as the turbine cannot be used during the repair.

In addition to this cost, there is the cost of labor and the machines necessary for decoupling the turbine from the compressor, inspecting the turbine blades and reassembling the turbine and the compressor.

An objective of the present invention is to provide a movement system for the inspection of a turbine, which allows an easy and rapid inspection of the turbine blades.

A further objective is to provide a movement system for the inspection of a turbine, which reduces the time and cost associated with inspecting the turbine.

Another objective is to provide a movement system for the inspection of a turbine, which avoids the necessity of having to decouple the shaft of the turbine from that of the compressor connected thereto.

A further objective is to provide a movement system for the inspection of a turbine, which can be easily applied to existing turbines.

BRIEF DESCRIPTION OF THE INVENTION

These objectives according to the present invention are achieved by providing a movement system for the inspection of a turbine as specified in claim 1.

Further characteristics of the invention are indicated in the subsequent description and claims.

BRIEF DESCRIPTION OF THE DRAWINGS

The characteristics and advantages of an inspection system for a turbine according to the present invention will appear more evident from the following illustrative and non-limiting description, referring to the enclosed schematic drawings, in which.

DETAILED DESCRIPTION OF THE PREFERRED EMBODIMENT

Figure 1:
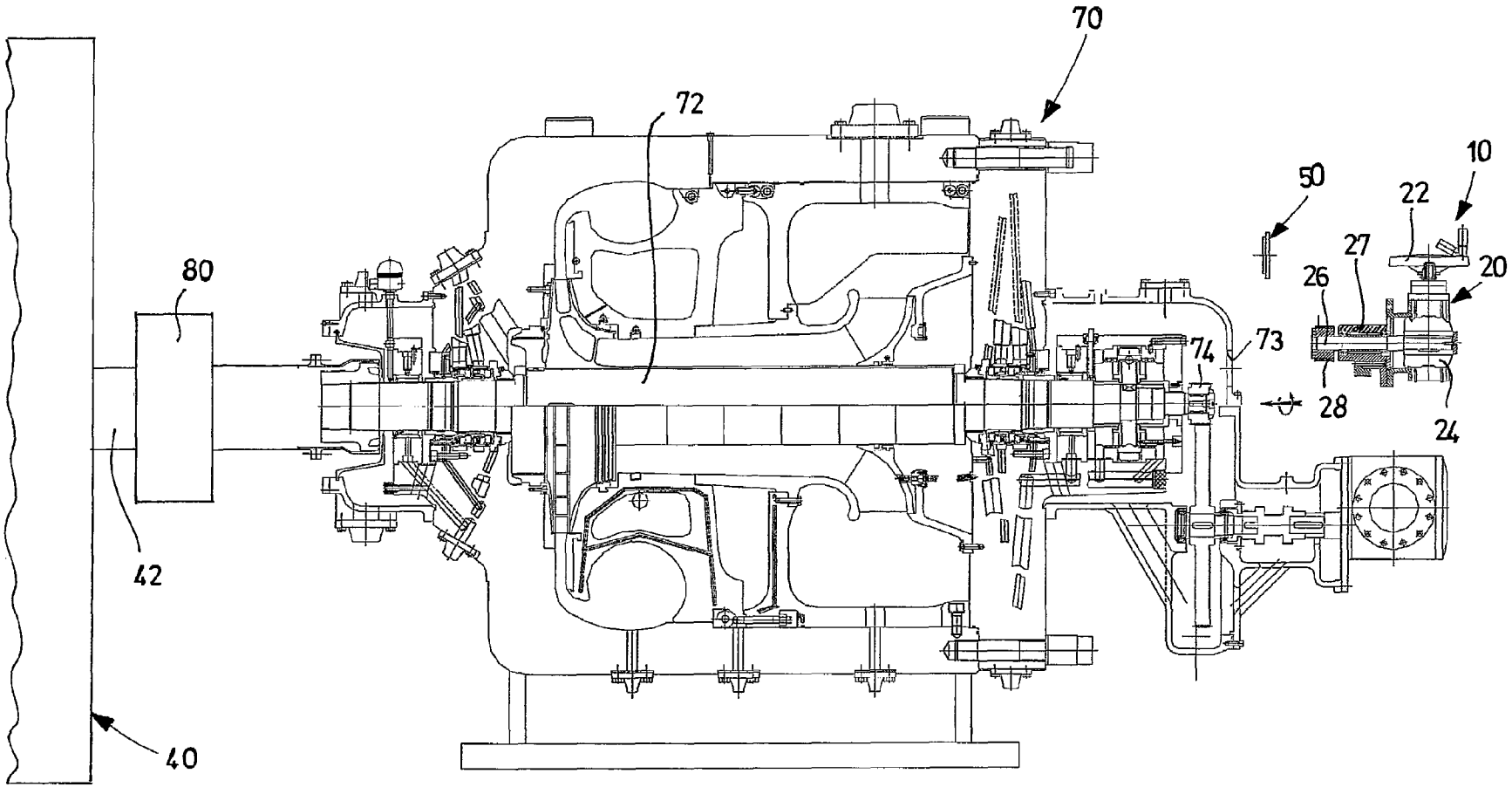
FIG. 1 is an exploded partially sectional raised schematic side view of a preferred embodiment of a movement system for the inspection of a turbine.

With reference to the figures, these show a movement system 10 for the inspection of a turbine 40 of the type equipped with a shaft 42 having a series of blades, for example a rotor, which is coupled to a shaft 72 or in any case to a rotor of a compressor 70 by means of a loading joint 80, schematically shown in FIG. 1.

Said movement system 10 comprises a crank rotation mechanism 20 which in turn comprises a reducer group 24 for rotating, in particular manually, said shaft 42 of said turbine 40 to allow the inspection of said series of blades by means of a boroscope, this at the same time avoiding the necessity of decoupling said turbine 40 from said compressor 70, for example avoiding the necessity of decoupling said shaft 42 from said turbine 40 from said shaft 72 of said compressor 70.

This occurs also because said reducer group 24 considerably reduces the force necessary for rotating said shaft 42 of said turbine 40.

The movement system 10 of the present invention allows the rotation of the whole rotor of the compressor 70 and the whole rotor of the turbine 40 with a simple rotating movement conferred to the shaft 72 of the compressor 70 by means of the crank rotation mechanism 20.

In this way, by transmitting the motion of the crank 22 by means of the reducer 24 to the shaft 42 of the turbine 40 with which said reducer is associated, it is possible to inspect all the blades of the turbine itself thus avoiding the necessity of dismantling or decoupling the turbine 40 from the compressor 70.

Said system 10 preferably comprises a shaft 26 equipped with a gear 28 integral therewith, which is suitable for being coupled with a gear 74 integral with the shaft 72 or the rotor with which said compressor 70 is equipped.

This allows a rotating movement to be transmitted to said shaft 72 or rotor of said compressor 70, thus rotating said shaft 42 or rotor of said turbine 40.

In this way, by transmitting a rotating movement to said shaft 26 it is possible to rotate the shaft 72 or rotor of the compressor 70 and consequently also the shaft 42 or rotor of the turbine 40 connected to the shaft 72 or rotor itself.

Said shaft 26 is connected between said reducer group 24 and said shaft 72 or rotor to allow the activation of said shaft 72 or rotor of said compressor 70 from its outside, and the shaft serves to transmit a rotating movement from the outside to said shaft 72 or rotor of said compressor 70.

Additionally, said shaft 26 can be partially inserted inside said compressor 70.

Said system 10 preferably comprises a supporting element 27 in which said shaft 26 of said crank rotation mechanism 20 is partially inserted and hinged.

Said supporting element 27 is preferably a tubular element equipped with a series of housings 29 for a corresponding series of supporting bearings 32 for said shaft 26.

Said crank rotation mechanism 20 preferably comprises a crank 22. Said crank 22 is connected to said reducer group 24 which in turn is connected to said shaft 26.

Said movement system 10 preferably comprises motor means, not shown in the figures, associated with said crank 22 for semi-automatically activating said crank rotation mechanism 20.

The movement system 10 can be assembled on the compressor 70 by simply removing the closing element 50 of the compressor 70 itself, which covers an opening 73 for said system 10, and inserting the system 10 inside said opening 73 and subsequently fixing the system 10 to the fixed structure of the compressor 70 by fixing means with which said movement system 10 is preferably equipped.

Figure 3:
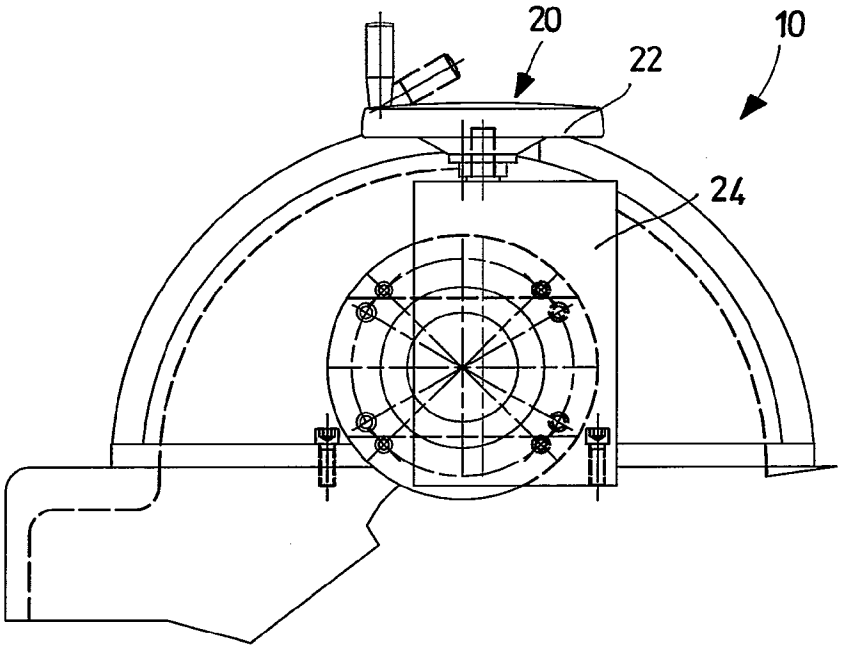
FIG. 3 is a raised front view of the detail of FIG. 2.
Figure 2:
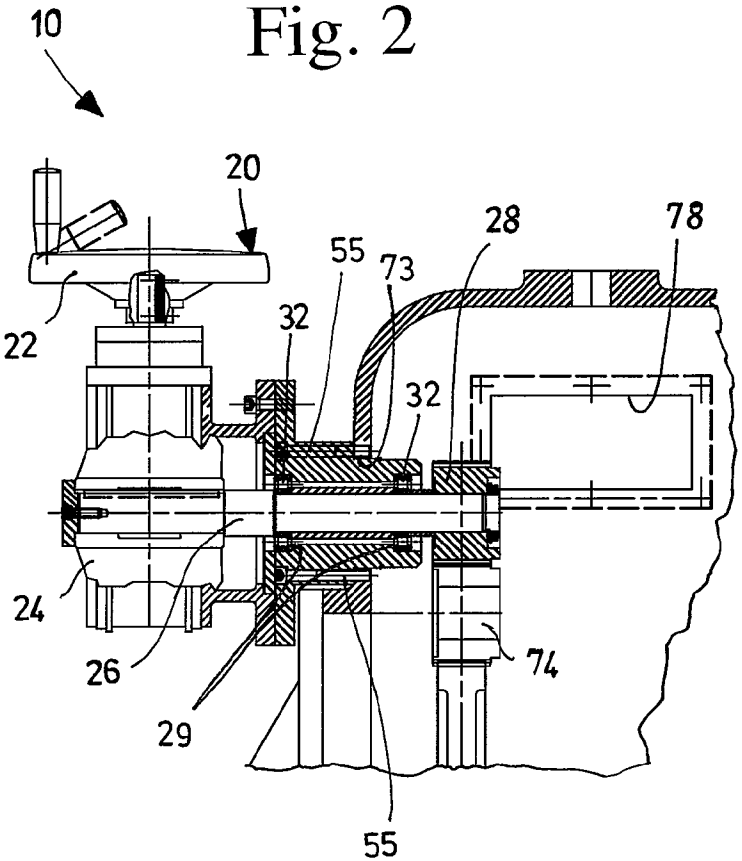
FIG. 2 is a partially sectional raised side view of a detail of FIG. 1.

Said fixing means preferably comprise a series of screws 55 or fixing elements of this or another type suitable for allowing said system 10 to be fixed to the fixed structure of said compressor 70. See FIGS. 2 and 3.

Furthermore, in order to facilitate the assembly of the system 10, it is possible to insert a door 78 in the fixed structure of said compressor 70 in a side portion with respect to said opening 73 in order to check whether the gear 28 is correctly engaged with the gear 74 of the compressor 70.

According to a further aspect of the present invention, a compressor 70 is provided together with a turbine 40 coupled by means of a loading joint 80 equipped with a system 10 of the type previously described for the movement and inspection of the turbine itself 40.

Figure 4:
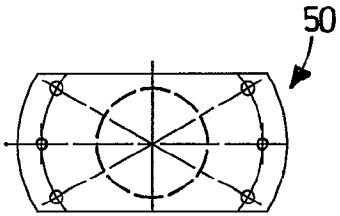
FIG. 4 shows a detail of FIG. 1 in a raised front view.

Said compressor 70, moreover, is preferably equipped with an opening 73 for the insertion of said system 10, which can be reclosed by means of a closing element 50. See FIG. 4.

Said opening 73 is situated close to an end of said shaft 72 of said compressor, and in particular close to a portion containing said gear 74 for a lubricating pump.

In particular said compressor 70 comprises a door 78 situated to the side of said opening 73 to assure that said gear 28 is correctly engaged with said gear 74 of said compressor 70 during the assembly of said movement system 10 on said compressor 70.

A movement system for the inspection of a turbine connected to a compressor advantageously allows the movement of the rotor of the compressor and consequently also of the turbine rotor itself, allowing the inspection of the turbine rotor and at the same time preventing the decoupling of the turbine from the rotor.

It can thus be seen that a movement system for the inspection of a turbine according to the present invention achieves the objectives specified above.

The movement system for the inspection of a turbine according to the pre-sent invention thus conceived can undergo numerous modifications and variations, all included in the same inventive concept.

Furthermore, in practice, the materials used as also the dimensions and components can vary according to technical demands.

While the present invention has been described in connection with what are presently considered to be the most practical and preferred embodiments, it is to be understood that the present invention is not limited to these herein disclosed embodiments. Rather, the present invention is intended to cover all of the various modifications and equivalent arrangements included within the spirit and scope of the appended claims.

What is claimed is:

1. A movement system for the inspection of a turbine of the type equipped with a shaft having a series of blades, which is coupled with a shaft of a compressor with a loading joint, the movement system comprising a crank rotation mechanism in turn comprising a reducer group for rotating said shaft of said turbine, the crank rotation mechanism being configured to effect the inspection of said series of blades with a boroscope, thus avoiding the necessity of decoupling said turbine from said compressor.

2. The system according to claim 1, further comprising a shaft equipped with a gear made integral with the same, which is connected between said reducer group and said shaft to allow the activation of said shaft of said compressor from its outside, said gear being suitable for being coupled with a gear fitted onto said shaft of said compressor in order to rotate said shaft of said compressor and to consequently rotate said shaft of said turbine.

3. The system according to claim 2, further comprising a supporting element in which said shaft of said crank rotation mechanism is partially inserted and hinged.

4. The system according to claim 3, wherein said supporting element is a tubular element equipped with a series of housings for a corresponding series of supporting bearings for said shaft.

5. The system according to claim 1, wherein said crank rotation mechanism comprises a crank.

6. The system (10) according to claim 5, wherein said crank (22) is connected to said reducer group (24) which in turn is connected to said shaft (26).

7. The system according to claim 1, further comprising a motor associated with said crank for semi-automatically activating said crank rotation mechanism.

8. A compressor and turbine unit coupled by a loading joint, said unit being equipped with a movement system the movement system for the inspection of a turbine of the type equipped with a shaft having a series of blades, which is coupled with a shaft of a compressor by a loading joint, the movement system comprises a crank rotation mechanism having a reducer group for rotating said shaft of said turbine, the crank rotation mechanism being configured to effect the inspection of said series of blades with a boroscope, thus avoiding the necessity of decoupling said turbine from said compressor.

9. The unit according to claim 8, wherein said compressor comprises an opening for the insertion of said system, which can be reclosed by a closing element (50).

* * * * *